US009646533B2

(12) United States Patent
Hong et al.

(10) Patent No.: US 9,646,533 B2
(45) Date of Patent: May 9, 2017

(54) ORGANIC LIGHT EMITTING DISPLAY DEVICE

(71) Applicant: LG Display Co., Ltd., Seoul (KR)

(72) Inventors: Sang Pyo Hong, Gyeonggi-do (KR); Ho Jin Ryu, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 64 days.

(21) Appl. No.: 14/565,630

(22) Filed: Dec. 10, 2014

(65) Prior Publication Data

US 2015/0170565 A1 Jun. 18, 2015

(30) Foreign Application Priority Data

Dec. 13, 2013 (KR) ..... 10-2013-0155584

(51) Int. Cl.
*G09G 3/30* (2006.01)
*G09G 3/3233* (2016.01)
*G09G 3/3225* (2016.01)

(52) U.S. Cl.
CPC ..... *G09G 3/3233* (2013.01); *G09G 3/3225* (2013.01); *G09G 2300/0819* (2013.01); *G09G 2310/067* (2013.01); *G09G 2320/0285* (2013.01); *G09G 2320/0295* (2013.01); *G09G 2320/043* (2013.01)

(58) Field of Classification Search
CPC .. G09G 3/30; G09G 5/00; G06F 3/038; G02F 1/1343; G02F 1/1335
See application file for complete search history.

(56) References Cited

U.S. PATENT DOCUMENTS 8,395,729 B2 * 3/2013 Han ..... G02F 1/133514 349/109
8,698,834 B2 * 4/2014 Brown Elliott ..... G09G 5/02 345/207
8,890,783 B2 * 11/2014 Chen ..... G02F 1/13338 345/90
2009/0140959 A1 6/2009 Nam et al.
2009/0309818 A1 12/2009 Kim
2011/0063268 A1 * 3/2011 Knapp ..... H04L 12/42 345/207

(Continued)

FOREIGN PATENT DOCUMENTS

CN 101615379 A 12/2009
CN 103165079 A 6/2013

(Continued)

OTHER PUBLICATIONS

The First Office Action dated Aug. 23, 2016 from The State Intellectual Property Office of the People's Republic of China in counterpart Chinese application No. 201410766540.0.

*Primary Examiner* — Pegeman Karimi
(74) *Attorney, Agent, or Firm* — Morgan, Lewis & Bockius LLP

(57) ABSTRACT

An organic light emitting display device that increases an aperture ratio is provided. The organic light emitting display device comprises a display panel that includes a plurality of sub pixels provided in a pixel region defined by a plurality of scan control lines and a plurality of data lines, each scan control line crossing each data line, wherein some of the plurality of sub pixels have a first aperture ratio, and the other sub pixels have a second aperture ratio smaller than the first aperture ratio.

9 Claims, 7 Drawing Sheets

(56) References Cited

U.S. PATENT DOCUMENTS

| | | | | |
|---|---|---|---|---|
| 2011/0122119 | A1 | 5/2011 | Bae et al. | |
| 2011/0227505 | A1 | 9/2011 | Park et al. | |
| 2013/0147690 | A1* | 6/2013 | Kim ..... | G09G 3/3233 345/76 |
| 2013/0147694 | A1 | 6/2013 | Kim et al. | |
| 2013/0162617 | A1 | 6/2013 | Yoon et al. | |

FOREIGN PATENT DOCUMENTS

| | | | |
|---|---|---|---|
| KR | 10-0846790 | B | 7/2008 |
| KR | 2009-0046983 | A | 5/2009 |
| KR | 2010-0047505 | A | 5/2010 |
| KR | 2011-0057534 | A | 6/2011 |
| KR | 10-1073226 | B | 10/2011 |
| KR | 2012-0045252 | A | 5/2012 |
| KR | 2013-0066449 | A | 6/2013 |
| KR | 2013-0066450 | A | 6/2013 |
| KR | 2013-0074147 | A | 7/2013 |
| WO | 2007/018381 | A1 | 2/2007 |

* cited by examiner

ORGANIC LIGHT EMITTING DISPLAY DEVICE

CROSS REFERENCE TO RELATED APPLICATIONS

This application claims the benefit of the Korean Patent Application No. 10-2013-0155584 filed on Dec. 13, 2013, which is hereby incorporated by reference for all purposes as if fully set forth herein.

BACKGROUND OF THE INVENTION

Field of the Invention

The present invention relates to an organic light emitting display device, and more particularly, to an organic light emitting display device that may increase an aperture ratio.

Discussion of the Related Art

Recently, with the development of multimedia, importance of flat panel display devices has been increased. In response to this trend, flat panel display devices such as a liquid crystal display device, a plasma display device and an organic light emitting display device have been commercialized. Of the flat panel display devices, the organic light emitting display device has received much attention as a flat panel display device for next generation, owning to advantages of fast response speed, low power consumption, and excellent viewing angle characteristic based on self-light emission.

FIG. 1 is a circuit diagram illustrating a pixel structure of a general organic light emitting display device.

Referring to FIG. 1, a pixel P of the general organic light emitting display device includes a pixel circuit PC and an organic light emitting device OLED.

The pixel circuit PC includes a switching transistor Tsw, a driving transistor Tdr, and a capacitor Cst.

The switching transistor Tsw is switched in accordance with a scan pulse SP supplied to a scan control line SL, and supplies a data voltage Vdata, which is supplied to a data line DL, to the driving transistor Tdr. The driving transistor Tdr is switched in accordance with the data voltage Vdata supplied from the switching transistor Tsw and controls a data current flowing to the organic light emitting device OLED. The capacitor Cst is connected between gate and source terminals of the driving transistor Tdr, and stores a voltage corresponding to the data voltage Vdata supplied to the gate terminal of the driving transistor Tdr and turns on the driving transistor Tdr at the stored voltage.

The organic light emitting device OLED is electrically connected between a drain terminal and a cathode line EVss of the driving transistor Tdr and emits light through the current flowing in accordance with switching of the driving transistor Tdr.

Each pixel P of the aforementioned general organic light emitting display device controls a size of the data current flowing in the organic light emitting device OLED by using switching of the driving transistor Tdr based on the data voltage Vdata, thereby displaying a predetermined image.

However, in the general organic light emitting display device, a problem occurs in that characteristic (or degradation) deviation of a threshold voltage Vth of the driving transistor Tdr occurs per pixel P due to process deviation caused by non-uniformity of a process of manufacturing a thin film transistor. Also, since degradation speed is varied per driving transistor during long time driving, a defect of picture quality, such as Mura, occurs. As methods for solving the problem caused by characteristic variation of the driving transistor of each pixel, internal compensation technique and external compensation technique are known.

According to the internal compensation technique, a compensation circuit, which includes at least one compensation transistor and at least one compensation capacitor, is added to the pixel circuit PC of each pixel P, and characteristic variation of the driving transistor of the corresponding pixel P is compensated internally through the compensation circuit.

According to the external compensation technique, characteristic variation of the driving transistor of each pixel P is sensed externally by at least a sensing unit of the pixel circuit PC of each pixel P and the sensed result is reflected in data of the corresponding pixel P, whereby characteristic variation of the driving transistor of the corresponding pixel P is compensated through data correction. This external compensation technique is disclosed in the Korean Laid-Open Patent No. 10-2013-0066449 (corresponding to US 2013/0147694).

However, the related art organic light emitting display device to which the internal compensation technique or the external compensation technique is applied has a problem in that an aperture ratio is deteriorated due to the transistor added to each pixel.

SUMMARY OF THE INVENTION

Accordingly, the present invention is directed to an organic light emitting display device that substantially obviates one or more problems due to limitations and disadvantages of the related art.

An object of the present invention is to provide an organic light emitting display device that may increase an aperture ratio.

Another object of the present invention is to provide an organic light emitting display device that may compensate for characteristic variation of a driving transistor included in each pixel while increasing an aperture ratio.

Additional features and advantages of the invention will be set forth in the description which follows, and in part will be apparent from the description, or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic light emitting display device comprises a display panel that includes a plurality of sub pixels provided in a pixel region defined by a plurality of scan control lines and a plurality of data lines, each scan control line crossing each data line, wherein some of the plurality of sub pixels have a first aperture ratio, and the other sub pixels have a second aperture ratio smaller than the first aperture ratio.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE ILLUSTRATED EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Terminologies disclosed in this specification should be understood as follows.

It is to be understood that the singular expression used in this specification includes the plural expression unless defined differently on the context. The terminologies such as "first" and "second" are intended to identify one element from another element, and it is to be understood that the scope of the present invention should not be limited by these terminologies. Also, it is to be understood that the terminologies such as "include" and "has" are intended so as not to exclude the presence or optional possibility of one or more features, numbers, steps, operations, elements, parts or their combination. Furthermore, it is to be understood that the terminology "at least one" is intended to include all combinations that may be suggested from one or more related items. For example, "at least one of a first item, a second item and a third item" means combination of all the items that may be suggested from two or more of the first item, the second item and the third item, as well as each of the first item, the second item and the third item.

Hereinafter, the example embodiments of an organic light emitting display device according to the present invention will be described with reference to the accompanying drawings.

Figure 1:
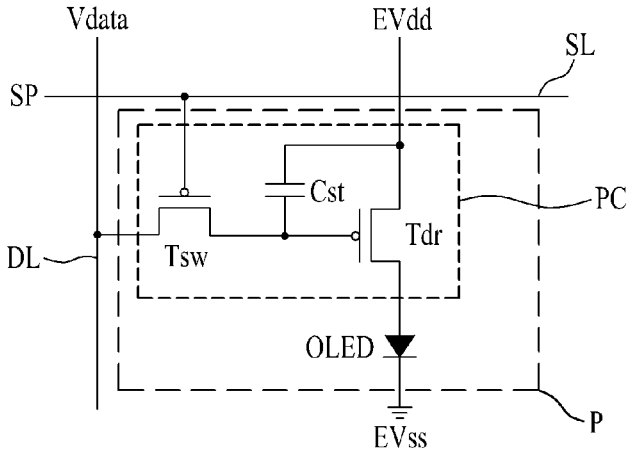
FIG. 1 Related Art
FIG. 1 is a circuit diagram illustrating a pixel structure of a general organic light emitting display device.
Figure 2:
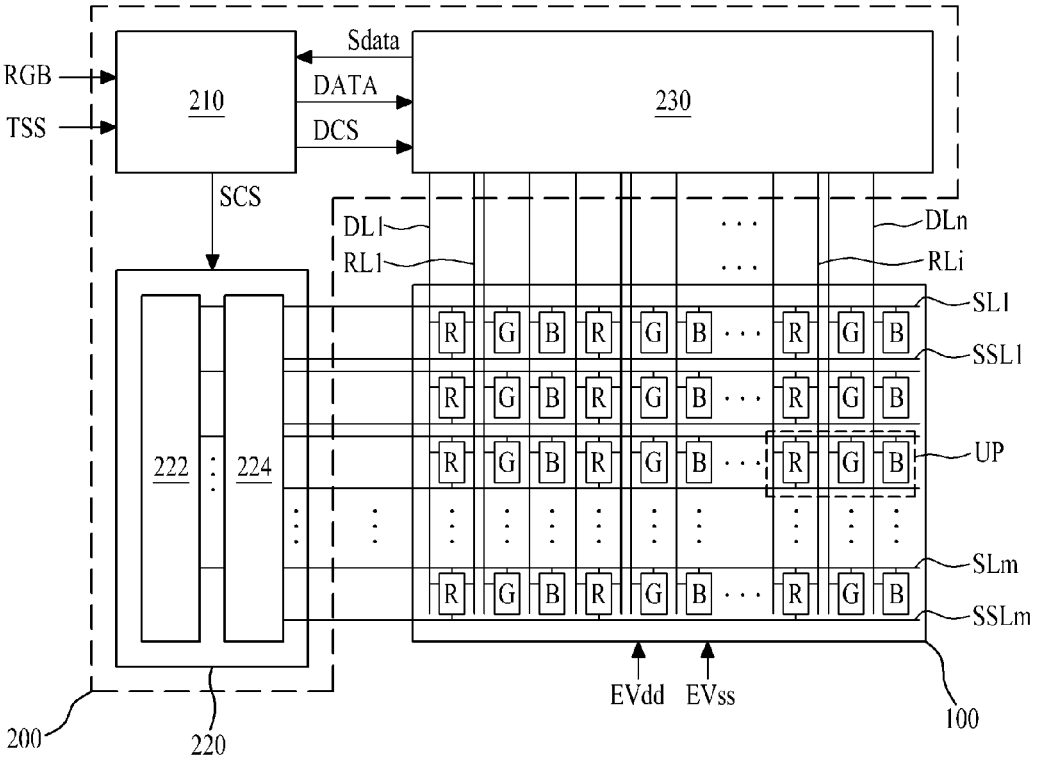
FIG. 2 is a diagram illustrating an organic light emitting display device according to the embodiment of the present invention.
Figure 3:
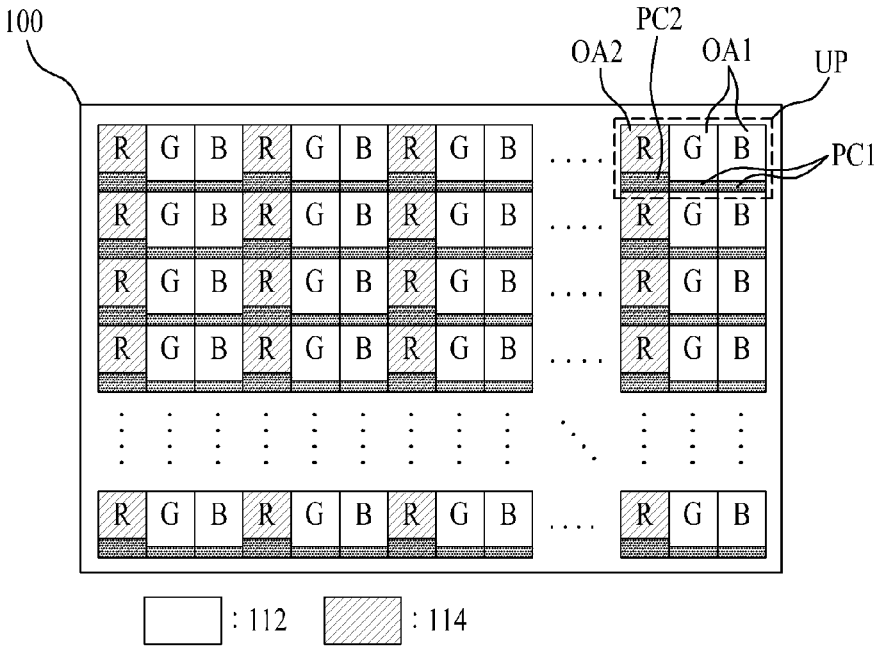
FIG. 3 is a diagram illustrating a pixel arrangement structure of a display panel shown in FIG. 2.
Figure 4:
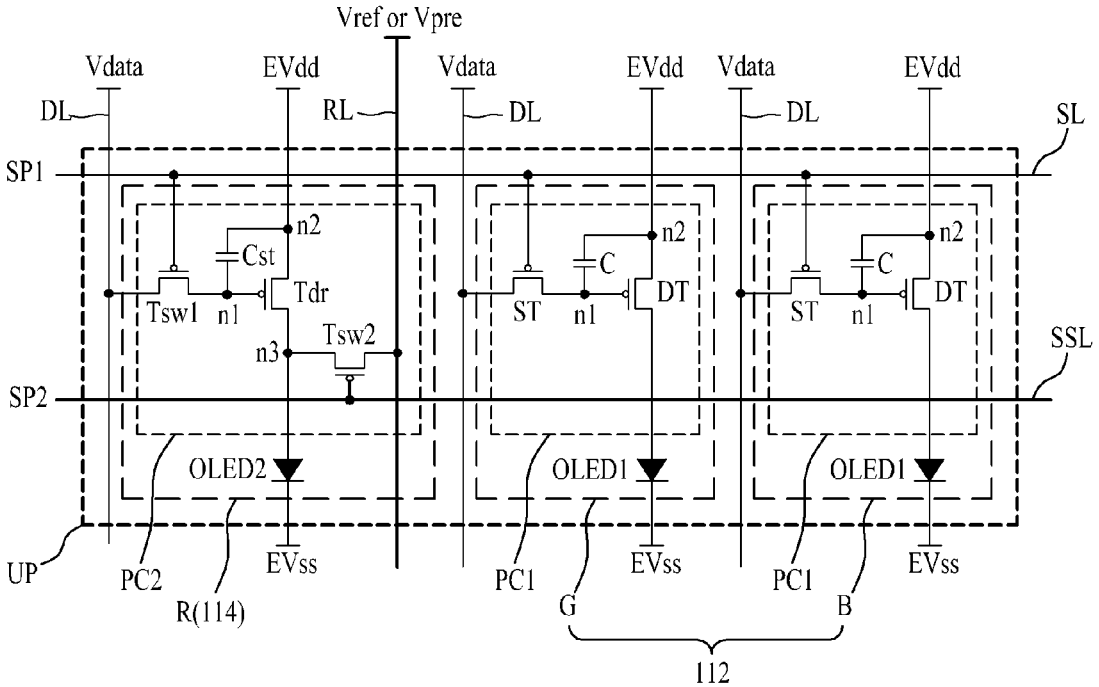
FIG. 4 is a diagram illustrating a pixel structure of a unit pixel shown in FIGS. 2 and 3.

FIG. 2 is a diagram briefly illustrating an organic light emitting display device according to the embodiment of the present invention, FIG. 3 is a diagram illustrating a pixel arrangement structure of a display panel shown in FIG. 2, and FIG. 4 is a diagram illustrating a pixel structure of a unit pixel shown in FIGS. 2 and 3.

Referring to FIGS. 2 to 4, an organic light emitting display device according to the embodiment of the present invention includes a display panel 100 and a panel driver 200.

The display panel 100 includes first to mth (m is a natural number) scan control lines SL1 to SLm, first to mth sensing control lines SSL1 to SSLm, first to nth (n is a natural number greater than m) data lines DL1 to DLn, first to ith (i is n/3) reference lines RL1 to RLi, and a plurality of sub pixels R, G and B.

The first to mth scan control lines SL1 to SLm are formed in parallel to have constant intervals along a first direction of the display panel 100, that is, a horizontal direction.

The first to mth sensing control lines SSL1 to SSLm are formed at constant intervals to be parallel with the scan control lines SL1 to SLm.

The first to nth data lines DL1 to DLn are formed in parallel to have constant intervals along a second direction of the display panel 100, that is, a vertical direction, thereby crossing the scan control lines SL1 to SLm and the sensing control lines SSL1 to SSLm.

The first to ith reference lines RL1 to RLi are formed in parallel with the data lines, so as to be connected with a sensing sub pixel only, which will be described later.

The display panel 100 further includes a plurality of first driving power lines for supplying a driving power EVdd of high voltage to each of the sub pixels R, G and B, and a second driving power line (or cathode electrode layer) for supplying a driving power (or ground power) EVss of low voltage to each of the sub pixels R, G and B.

The plurality of sub pixels R, G and B are formed per pixel region defined by each of the first to mth scan control lines SL1 to SLm and each of the first to nth data lines DL1 to DLn, wherein the scan control lines cross the data lines.

Some sub pixels G and B of the plurality of sub pixels R, G and B are formed to have a first aperture ratio OA1, and the other sub pixel B is formed to have a second aperture ratio OA2 smaller than the first aperture ratio OA1. The three sub pixels R, G and B arranged to be adjacent with one another along a longitudinal direction of the scan control lines SL1 to SLm constitute one unit pixel UP that displays one color image. At this time, some sub pixels G and B of the three sub pixels R, G and B constituting one unit pixel UP are formed to have the first aperture ratio OA1, and the other sub pixel B is formed to have the second aperture ratio OA2.

The plurality of sub pixels R, G and B may be one of red sub pixel R, green sub pixel G and blue sub pixel B. One unit pixel UP may be comprised of the red sub pixel R, the green sub pixel G and the blue sub pixel B. At this time, each of the green sub pixel G and the blue sub pixel B is formed to have the first aperture ratio OA1, and the red sub pixel R is formed to have the second aperture ratio OA2. In the following description, the sub pixel of each unit pixel UP, which has the first aperture ration OA1, will be defined as a "non-sensing sub pixel 112", and the sub pixel of each unit pixel UP, which has the second aperture ration OA2, will be defined as a "sensing sub pixel 114".

The non-sensing sub pixel 112 may include a first pixel circuit PC1 and a first organic light emitting device OLED1.

The first pixel circuit PC1 is formed in a transistor region defined in the pixel region, and includes a switching transistor ST, a first driving transistor DT and a capacitor C. In this case, each of the transistors ST and DT is a P type thin film transistor TFT, and may be any one of a-Si TFT, a poly-Si TFT, an Oxide TFT and an Organic TFT.

The switching transistor ST is switched in accordance with a first scan pulse SP1 supplied to the scan control line SL and outputs a data voltage Vdata supplied to the data line DL. To this end, the switching transistor ST includes a gate electrode connected to the scan control line SL, a source electrode connected to its adjacent data line DL, and a drain electrode connected to a first node n1 which is a gate electrode of the first driving transistor DT.

The first driving transistor DT is switched in accordance with the data voltage Vdata supplied from the switching transistor ST and controls a data current flowing in the first organic light emitting device OLED1. To this end, the first driving transistor DT includes a gate electrode connected to the first node n1, a source electrode connected to a second node n2 connected to the first driving power line, and a drain electrode connected to the first organic light emitting device OLED1.

The capacitor C is connected between gate and source terminals of the first driving transistor DT to store a voltage corresponding to the data voltage Vdata supplied to the gate terminal of the first driving transistor DT and turns on the first driving transistor DT at the stored voltage. To this end, a first electrode of the capacitor C is connected to the first node n1, and a second electrode of the capacitor C is connected to the second node n2 which is the source electrode of the first driving transistor DT.

The first organic light emitting device OLED1 is formed in the other opening region except for the transistor region of the pixel region, and is electrically connected between the drain electrode of the first driving transistor DT and the second driving power line. This first organic light emitting device OLED1 emits color light corresponding to the corresponding sub pixel through the data current flowing in accordance with switching of the first driving transistor DT.

The aforementioned non-sensing sub pixel 112 has the first aperture ratio OA1 in accordance with a size of the opening region which is the other region except for the transistor region where the first pixel circuit PC1 is formed in the pixel region.

The sensing sub pixel 114 may include a second pixel circuit PC2 and a second organic light emitting device OLED2.

The second pixel circuit PC2 is formed in the transistor region defined in the pixel region, and includes a first switching transistor Tsw1, a second switching transistor Tsw2, a driving transistor Tdr and a capacitor Cst. In this case, the transistors Tsw, Tsw2 and Tdr are the same P type thin film transistors TFTs as those included in the first pixel circuit PC1.

The first switching transistor Tsw1 is switched in accordance with the first scan pulse SP1 supplied to the scan control line SL and outputs the data voltage Vdata supplied to the data line DL. To this end, the first switching transistor Tsw1 includes a gate electrode connected to its adjacent scan control line SL, a source electrode connected to its adjacent data line DL, and a drain electrode connected to a first node n1 which is a gate electrode of the second driving transistor Tdr.

The second switching transistor Tsw2 is switched in accordance with a second scan pulse SP2 supplied to the sensing control line SSL and supplies a voltage Vref or Vpre, which is supplied to the reference line RL, to the drain electrode of the second driving transistor Tdr and a third node n3 connected to an anode electrode of the second organic light emitting device OLED2. To this end, the second driving transistor Tsw2 includes a gate electrode connected to its adjacent sensing control line SSL, a source electrode connected to its adjacent reference line RL, and a drain electrode connected to the third node n3.

The capacitor Cst includes first and second electrodes connected between the gate and source electrodes of the second driving transistor Tdr, that is, the first and second nodes n1 and n2. The first electrode of the capacitor Cst is connected to the first node n1, and the second electrode of the capacitor Cst is connected to the second node n2 connected to the first driving power line. This capacitor Cst charges a difference voltage of voltages supplied to the first and second nodes n1 and n2 in accordance with switching of each of the first and second switching transistors Tsw1 and Tsw2, and then switches the second driving transistor Tdr in accordance with the charged voltage.

The second driving transistor Tdr is turned on by the voltage of the capacitor Cst and controls the amount of a current flowing in the second organic light emitting device OLED2. To this end, the second driving transistor Tdr includes a gate electrode connected to the first node n1, a source electrode connected to the second node n2 connected to the first driving power line, and a drain electrode connected to the third node n3.

The second organic light emitting device OLED2 is formed in the other opening region except for the transistor region of the pixel region, and is electrically connected between the drain electrode of the second driving transistor Tdr and the second driving power line. This second organic light emitting device OLED2 emits color light corresponding to the corresponding sub pixel through the data current flowing in accordance with switching of the second driving transistor Tdr.

The aforementioned sensing sub pixel 114 has the second aperture ratio OA2 in accordance with a size of the opening region which is the other region except for the transistor region where the second pixel circuit PC2 is formed in the pixel region. In this case, since the second pixel circuit PC2 of the sensing sub pixel 114 includes the switching transistors more than those of the first pixel circuit PC1 of the non-sensing sub pixel 112, the sensing sub pixel 114 has the second aperture ratio OA2 smaller than the first aperture ratio OA1 of the non-sensing sub pixel 112. As a result, in the structure that characteristic variation of the driving transistor is compensated by adding the transistor to the pixel circuit, the unit pixel of the related art includes a total of nine transistors, whereas the unit pixel of the present invention includes a total of seven transistors. Accordingly, the unit pixel UP of the present invention includes the transistors reduced as much as two in comparison with the unit pixel of the related art, whereby the aperture ratio is increased.

The panel driver 200 drives the display panel 100 in a sensing mode or a display mode. In this case, the sensing mode may be performed in accordance with setting of a user, or per set period (or time) or per blank period of at least one frame that displays image.

The panel driver 200 generates sensing data Sdata by sensing characteristic variation (for example, threshold voltage and/or mobility) of the second driving transistor Tdr included in the sensing sub pixel 114 through each of the first to ith reference lines RL1 to RLi formed in the display panel 100, during the sensing mode, and compensates for characteristic variation of the driving transistors DT and Tdr included in the respective sub pixels R, G and B by correcting the data voltage supplied to the respective sub pixels R, G and B on the basis of the sensing data Sdata for the sensing sub pixel 114. To this end, the panel driver 200 may include a timing controller 210, a row driver 220, and a column driver 230.

The timing controller 210 controls the row driver 220 and the column driver 230 in the sensing mode or the display mode by respectively generating a scan control signal SCS for controlling driving of the row driver 220 and a data control signal DCS for controlling driving of the column driver 230 on the basis of a timing synchronization signal TSS which is externally input. Also, the timing controller 210 generates compensation data for compensating for characteristic variation of the driving transistors DT and Tdr included in the respective sub pixels R, G and B on the basis of the sensing data Sdata provided from the column driver 230 in accordance with the sensing mode, and generates pixel data DATA by correcting input data RGB of the respective sub pixels R, G and B in accordance with the compensation data.

The row driver 220 sequentially generates first scan pulses SP1 in response to the scan control signal SCS supplied from the timing controller 210 and sequentially supplies the first scan pulses SP1 to the first to mth scan control lines SL1 to SLm, and also sequentially generates second scan pulses SP2 in response to the scan control signal SCS and sequentially supplies the second scan pulses SP2 to the first to mth sensing control lines SSL1 to SSLm. In this case, the scan control signal SCS may include a start signal and a plurality of clock signals.

For example, the row driver 220 may include a scan control line driver 222 and a sensing control line driver 224.

The scan control line driver 222 is connected to one side and/or the other side of each of the first to mth scan control lines SL1 to SLm. This scan control line driver 222 generates the first scan pulses SP1 sequentially shifted on the basis of the scan control signal SCS and sequentially supplies the generated first scan pulses SP1 to the first to mth scan control lines SL1 to SLm.

The sensing control line driver 224 is connected to one side and/or the other side of each of the first to mth sensing control lines SSL1 to SSLm. This sensing control line driver 224 generates the second scan pulses SP2 sequentially shifted on the basis of the scan control signal SCS and sequentially supplies the generated second scan pulses SP2 to the first to mth sensing control lines SSL1 to SSLm. The sensing control line driver 224 may generate the second scan pulses SP2 in accordance with the scan control signal SCS supplied to the scan control line driver 222 and the other scan control signal. In this case, the sensing control line driver 224 may generate the second scan pulses SP2 in case of the sensing mode only and supply the generated second scan pulses SP2 to the first to the mth sensing control lines SSL1 to SSLm. In this case, the second switching transistor Tsw2 included in the aforementioned sensing sub pixel R is driven in case of the sensing mode only and is not driven in case of the display mode.

Meanwhile, the sensing control line SSL is connected to the sensing sub pixel 114 only. At this time, the scan control line SL and the sensing control line SSL, which are arranged in the sensing sub pixel 114, may be formed to be connected to each other. In this case, any one of the scan control line driver 222 and the sensing control line driver 224 will be omitted.

Meanwhile, the row driver 220 may directly be formed on the display panel 100 together with a process of forming a thin film transistor of each sub pixel P, or may be formed in the form of an integrated circuit IC, whereby the row driver 220 may be connected to one side and/or the other side of the scan control line SL and the sensing control line SSL.

The column driver 230 is connected to the first to nth data lines DL1 to DLn and the first to ith reference lines RL1 to RLi, and is driven in the sensing mode and the display mode in accordance with mode control of the timing controller 210.

In case of the sensing mode, the column driver 230 generates the sensing data Sdata by sensing characteristic variation of the second driving transistor Tdr included in each pixel P in response to the data control signal DCS of the sensing mode, which is supplied from the timing controller 210, and provides the generated sensing data Sdata to the timing controller 210. Also, in case of the display mode, the column driver 230 converts pixel data DATA, which is supplied from the timing controller 210 in a unit of horizontal line by using a plurality of reference gamma voltages RGV supplied from a reference gamma voltage supply (not shown), to the data voltage in accordance with the data control signal DCS of the display mode, which is supplied from the timing controller 210, and supplies the converted voltage to the corresponding data lines DL1 to DLn. In this case, the column driver 230 may supply the reference voltage Vref to each of the first to nth reference lines RL1 to RLi in accordance with the data control signal DCS of the display mode, during the sensing mode.

Figure 5:
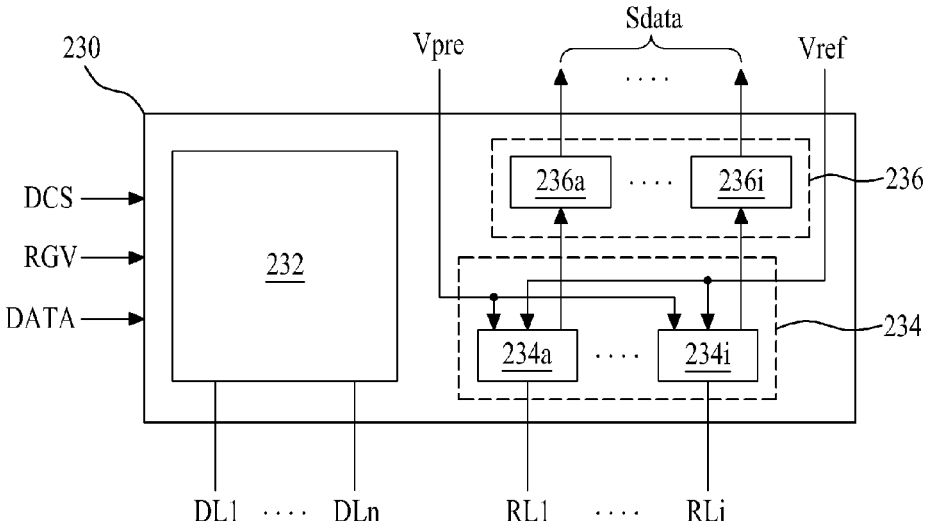
FIG. 5 is a block diagram illustrating a column driver shown in FIG. 2.

The column driver 230 according to one example includes a data driver 232, a switching unit 234 and a sensing unit 236 as shown in FIG. 5.

The data driver 232 converts the pixel data (or sensing pixel data) DATA supplied from the timing controller 210 to the data voltage Vdata in response to the data control signal DCS supplied from the timing controller 210 in accordance with the display mode or the sensing mode, and supplies the converted voltage to the corresponding data lines DL1 to DLn. In other words, the data driver 232 samples the data DATA of each pixel P, which are input in a unit of one horizontal line, in accordance with the data control signal DCS, selects a gamma voltage corresponding to a grayscale value of the sampled data from the plurality of reference gamma voltages RGV supplied from the reference gamma voltage supply (not shown) as the data voltage, and supplies the selected voltage to the corresponding data line DL of each pixel P.

The switching unit 234 supplies the reference voltage Vref, which is externally supplied, to each of the first to ith reference lines RL1 to RLi in response to the data control signal DCS supplied from the timing controller 210. Also, the switching unit 234 supplies a precharging voltage Vpre, which is externally supplied, to each of the first to ith reference lines RL1 to RLi in response to the data control signal DCS supplied from the timing controller 210 during the sensing mode, resets each of the first to ith reference lines RL1 to RLi to the precharging voltage Vpre, and then connects each of the first to ith reference lines RL1 to RLi to the sensing unit 236. To this end, the switching unit 234 according to one example may include first to ith selectors 234*a* to 234*i* connected to each of the first to ith reference lines RL1 to RLi and the sensing unit 236, wherein the selectors 234*a* to 234*i* may be comprised of multiplexers.

In case of the sensing mode, the sensing unit 236 is connected to the first to ith reference lines RL1 to RLi through the switching unit 234 and senses the voltage of each of the first to ith reference lines RL1 to RLi, and generates the sensing data Sdata corresponding to the sensed voltage and provides the generated data to the timing controller 210. To this end, the sensing unit 236 may include first to ith analog-to-digital converters 236*a* to 236*i* which are connected to the first to ith reference lines RL1 to RLi through the switching unit 234, convert the sensed voltage to an analog voltage, and generate the sensing data Sdata.

Figure 6:
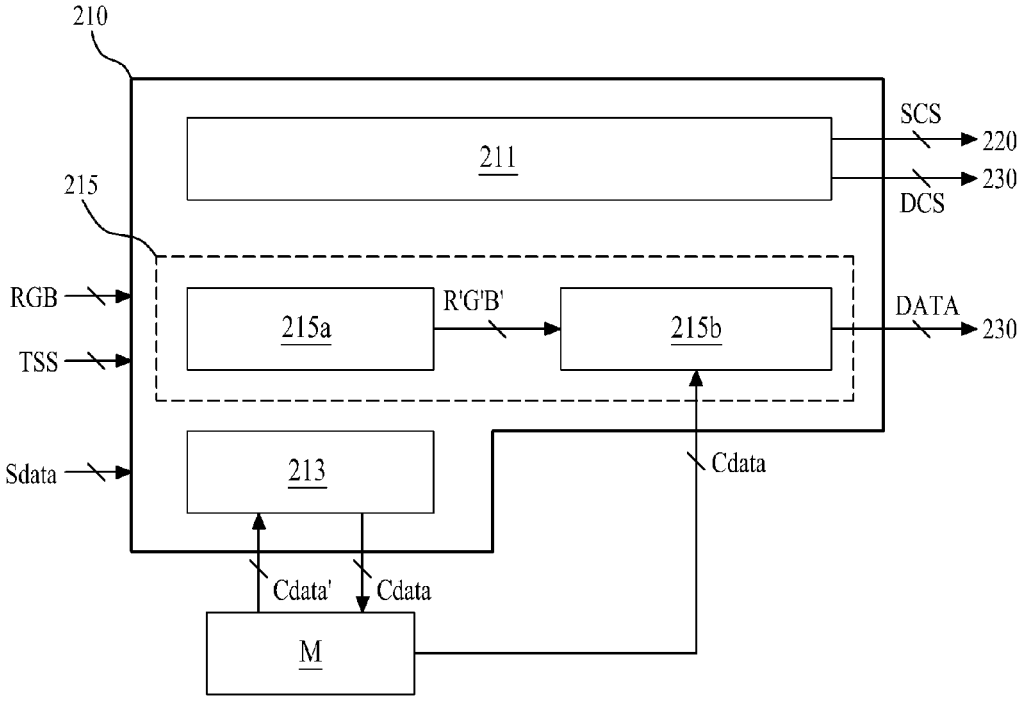
FIG. 6 is a block diagram illustrating a timing controller shown in FIG. 2.

FIG. 6 is a block diagram illustrating a timing controller shown in FIG. 2.

Referring to FIG. 6 in connection with FIGS. 2 to 5, the timing controller 210 according to the present invention includes a control signal generator 211, a sensing data processor 213, and a data processor 215.

The control signal generator 211 respectively generates a scan control signal SCS for controlling driving of the row driver 220 and a data control signal DCS for controlling driving of the column driver 230 on the basis of the timing synchronization signal TSS such as vertical synchronization signal, horizontal synchronization signal, data enable signal and main clock.

The sensing data processor 213 receives the sensing data Sdata of the sensing sub pixel 114, which are provided from the column driver 230 by driving of each pixel P according to the sensing mode, generates compensation data Cdata of each of the sub pixels R, G and B, which are intended to compensate for characteristic variation of the driving transistors DT and Tdr included in the respective sub pixels R, G and B, on the basis of the received sensing data Sdata, and stores the generated compensation data Cdata in a memory M. In this case, since the sensing data Sdata according to the aforementioned sensing mode correspond to characteristic variation of the second driving transistor Tdr included in the sensing sub pixel 114 of the sub pixels R, G and B of each unit pixel UP, the sensing data processor 213 generates the compensation data Cdata for compensating for characteristic variation of the first driving transistor DT included in the non-sensing sub pixel 112 of the sub pixels R, G and B of each unit pixel UP through linear interpolation or bilinear interpolation based on the sensing data Sdata of the sensing sub pixel 114. This will be described in more detail as follows.

First of all, the sensing data processor 213 reads previous compensation data Cdata' which are stored in a memory M1 and correspond to the sensing sub pixel 114, calculates a deviation value by comparing the previous compensation data Cdata' with the sensing data Sdata read from the memory M1, generates the compensation data Cdata of the sensing sub pixel 114 by adding or subtracting the calculated deviation value to or from the previous compensation data Cdata', and then updates the compensation data Cdata of the sensing sub pixel 114 by storing the compensation data Cdata in the memory M.

Then, the sensing data processor 213 generates compensation data Cdata for compensating for characteristic variation of the first driving transistor DT included in the non-sensing sub pixel 112, that is, the other sub pixels G and B of each unit pixel UP, through linear interpolation or bilinear interpolation based on the compensation data Cdata, stores the generated compensation data Cdata of the non-sensing sub pixel 112 in the memory M, and updates the compensation data Cdata. As a result, the compensation data Cdata of all the sub pixels R, G and B, that is, the compensation data Cdata of each of the sensing sub pixels 114 sensed by the sensing mode, and the compensation data Cdata of each of the non-sensing sub pixels 112 generated by interpolation based on the compensation data Cdata of each of the sensing sub pixels 114 are stored in the memory M. The memory M may be an internal memory built in the timing controller 210 or an external flash memory which is externally arranged.

Figure 7A:
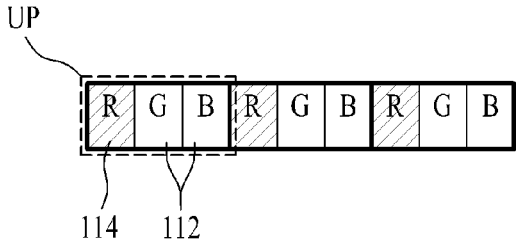
FIGS. 7*a* to 7*c* are diagrams illustrating an interpolation method for generating compensation data of a non-sensing sub pixel in a sensing data processor shown in FIG. 6.

The sensing data processor 213 according to one example, as shown in FIG. 7A, may generate the compensation data Cdata of the non-sensing sub pixels G and B, which are intended to compensate for characteristic variation of the first driving transistor DT included in the non-sensing sub pixels G and B, that is, each of the other sub pixels G and B of each unit pixel UP, through linear interpolation for obtaining an average value of the compensation data Cdata of the sensing sub pixels 114 corresponding to two unit pixels UP adjacent to each other in a left and right direction based on a longitudinal direction of the scan control line.

Figure 7B:
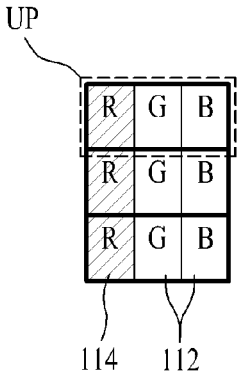

The sensing data processor 213 according to another example, as shown in FIG. 7*b*, may generate the compensation data Cdata of the non-sensing sub pixels G and B, which are intended to compensate for characteristic variation of the first driving transistor DT included in the non-sensing sub pixels G and B, that is, each of the other sub pixels G and B of each unit pixel UP, through linear interpolation for obtaining an average value of the compensation data Cdata of the sensing sub pixels 114 corresponding to two unit pixels UP adjacent to each other in an up and down direction based on a longitudinal direction of the data line.

Figure 7C:
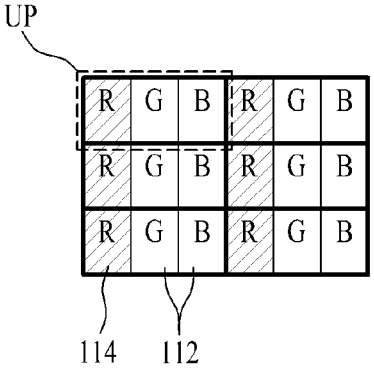

The sensing data processor 213 according to other example, as shown in FIG. 7C, may generate the compensation data Cdata of the non-sensing sub pixels G and B, which are intended to compensate for characteristic variation of the first driving transistor DT included in the non-sensing sub pixels G and B, that is, each of the other sub pixels G and B of each unit pixel UP, through bilinear interpolation for obtaining an average value of the compensation data Cdata of the sensing sub pixels 114 set in up and down and left and right directions or peripheral unit pixels UP.

Referring to FIG. 6 again, the data processor 215 generates pixel data DATA by correcting input data RGB of input image input from an external driving system (or graphic card) on the basis of the compensation data Cdata of the respective sub pixels R, G and B, which are stored in the memory M, and provides the generated pixel data DATA to the column driver 230. To this end, the data processor 215 according to one example may include a data alignment unit 215*a* and a data correction unit 215*b*.

The data alignment unit 215*a* generates alignment data R'G'B' of the respective sub pixels R, G and B by aligning the input data RGB of the input image to correspond to a pixel arrangement structure of the display panel 100.

The data correction unit 215*b* reads the compensation data Cdata corresponding to the respective sub pixels R, G and B from the memory M, and generates the pixel data DATA, which will be displayed in the respective sub pixels R, G and B, by adding the read compensation data Cdata to the alignment data R'G'B' of the respective sub pixels R, G and B supplied from the data alignment unit 215*a*. Then, the data correction unit 215*b* supplies the pixel data DATA of the respective sub pixels R, G and B to the column driver 230 through data interfacing which is set.

Figure 8:
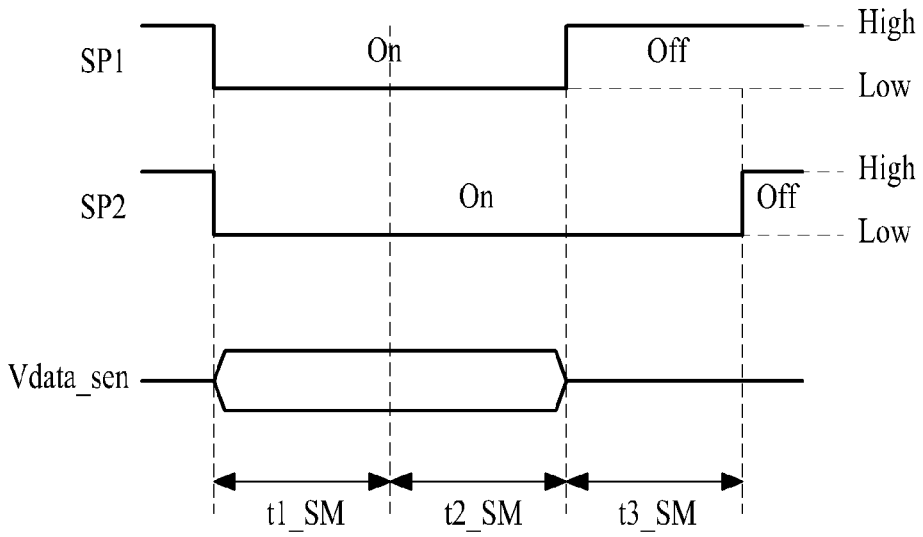
FIG. 8 is a waveform diagram illustrating a driving waveform during a sensing mode of an organic light emitting display device according to the embodiment of the present invention.

FIG. 8 is a waveform diagram illustrating a driving waveform during a sensing mode of an organic light emitting display device according to the embodiment of the present invention.

The sensing mode for sensing characteristic variation of the second driving transistor Tdr included in the sensing sub pixel 114 set per unit pixel UP of the display panel 100 will be described with reference to FIG. 8 in connection with FIGS. 2 and 4 to 6.

First of all, during the sensing mode, the panel driver 200 senses characteristic variation of the second driving transistor Tdr included in the sensing sub pixel 114 set per unit pixel UP of the display panel 100. To this end, the aforementioned timing controller 210 generates a data control signal DCS and a scan control signal SCS, which are intended to drive the sensing sub pixel 114 for first to third time periods t1_SM, t2_SM and t3_SM and supplies the generated signals to the row driver 220 and the column driver 230, and at the same time generates sensing pixel data DATA which is a bias voltage supplied to the gate electrode of the second driving transistor Tdr and supplies the generated sensing pixel data DATA to the column driver 230.

For the first time period t1_SM, the first switching transistor Tsw1 is turned on by the first scan pulse SP1 of low voltage, whereby a sensing data voltage Vdata_sen supplied to the data line DL is supplied to the first node n1, that is, the gate electrode of the second driving transistor Tdr, and the second switching transistor Tsw2 is turned on by the second scan pulse SP2 of low voltage, whereby a precharging voltage Vpre supplied to the reference line RL by switching of the switching unit 234 included in the column driver 230 is supplied to the third node n3, that is, the drain electrode of the second driving transistor Tdr and the anode electrode of the second organic light emitting device OLED2. At this time, the sensing data voltage Vdata_sen has a level of a target voltage set to sense a threshold voltage of the second driving transistor Tdr. As a result, the reference line RL is reset to the precharging voltage Vpre for the first time period t1_SM.

Then, for the second time period t2_SM, since the turn-on state of the first switching transistor Tsw1 is maintained by the first scan pulse SP1 of low voltage, the gate voltage of the second driving transistor Tdr is fixed to the voltage level of the sensing data voltage Vdata_sen. At this time, the reference line RL is floated by switching of the switching unit 234. As a result, the second driving transistor Tdr is driven in a saturation driving mode by the sensing data voltage V data_sen which is the bias voltage supplied to the gate electrode, whereby a difference voltage Vdata−Vth of the sensing data voltage Vdata_sen and the threshold voltage Vth of the second driving transistor Tdr is charged in the reference line RL of the floating state.

Afterwards, for the third time period t3_SM, the first switching transistor Tsw1 is turned off by the first scan pulse SP1 of high voltage, and the reference line RL is connected to the sensing unit 236 by switching of the switching unit 234 in a state that the turn-on state of the second switching transistor Tsw2 is maintained by the second scan pulse SP2 of low voltage. As a result, the sensing unit 236 senses the voltage Vsen of the reference line RL, generates the sensing data Sdata by converting the sensed voltage Vsen, that is, the threshold voltage of the second driving transistor Tdr, to an analog-to-digital voltage, and provides the generated sensing data Sdata to the timing controller 210.

Figure 9:
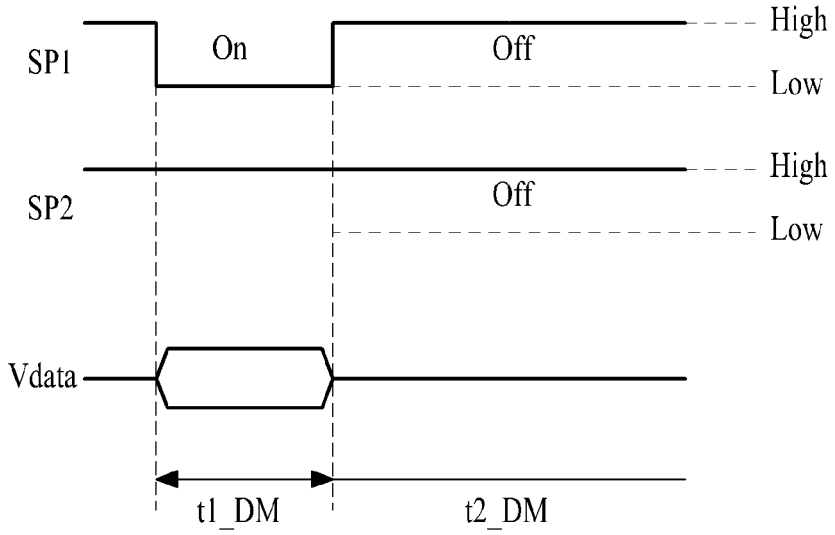
FIG. 9 is a waveform diagram illustrating a driving waveform during a display mode of an organic light emitting display device according to the embodiment of the present invention.

FIG. 9 is a waveform diagram illustrating a driving waveform during a display mode of an organic light emitting display device according to the embodiment of the present invention.

The display mode for displaying images in respective sub pixels R, G and B of the display panel 100 will be described with reference to FIG. 9 in connection with FIGS. 2 and 4 to 6.

First of all, during the display mode, the timing controller 210 generates a data control signal DCS and a scan control signal SCS, which are intended to drive the sub pixels R, G and B for an addressing time period t1_DM and a light emitting time period t2_DM and supplies the generated signals to the row driver 220 and the column driver 230, and at the same time generates pixel data DATA by correcting input data RGB of the respective sub pixels R, G and B as described above on the basis of the sensing data Sdata sensed by the sensing mode and supplies the generated pixel data DATA to the column driver 230. In this case, the compensation value for compensating for characteristic variation of the driving transistors DT and Tdr included in the respective sub pixels R, G and B is included in the pixel data DATA.

First of all, at the non-sensing sub pixel 112 for the addressing time period t1_DM, the switching transistor ST is turned on by the first scan pulse SP1 of low voltage, whereby the data voltage Vdata supplied to the data line DL is supplied to the first node n1, that is, the gate electrode of the first driving transistor DT. As a result, the data voltage Vdata is charged in the capacitor Cst connected to the first node n1 and the second node n2 of each of the non-sensing sub pixels 112.

Simultaneously, at the sensing sub pixel 114 for the addressing time period t1_DM, the first switching transistor Tsw1 is turned on by the first scan pulse SP1 of low voltage, whereby the data voltage Vdata supplied to the data line DL is supplied to the first node n1, that is, the gate electrode of the second driving transistor Tdr. As a result, the difference voltage of the data voltage Vdata and the driving voltage EVdd supplied to the first driving power line is charged in the capacitor Cst connected to the first node n1 and the second node n2. In this case, the data voltage Vdata charged in the capacitor Cst includes the compensation voltage for compensating for the threshold voltage of the second driving transistor Tdr.

Then, at the non-sensing sub pixel 112 for the light emitting time period t2_DM, the switching transistor ST is turned off by the first scan pulse SP1 of high voltage, whereby the first driving transistor DT is turned on by the voltage stored in the capacitor C. Simultaneously, at the sensing sub pixel 114 for the light emitting time period t2_DM, the first switching transistor Tsw1 is turned off by the first scan pulse SP1 of high voltage, whereby the second driving transistor Tdr is turned on by the voltage stored in the capacitor Cst. Accordingly, at each of the non-sensing sub pixel 112 and the sensing sub pixel 114 for the light emitting time period t2_DM, the organic light emitting diodes OLED1 and OLED2 emit light through the current flowing in the tuned-on driving transistors DT and Tdr and continue to emit light to reach the addressing time period t1_DM of next frame as the gate-source voltage Vgs of the driving transistors DT and Tdr are sustained by the voltages of the capacitors C and Cst. In this case, the current flowing in the organic light emitting diodes OLED1 and OLED2 is not affected by the threshold voltage of the driving transistors DT and Tdr due to the compensation voltage included in the data voltage Vdata as described above.

In the aforementioned organic light emitting display device according to the embodiment of the present invention, any one of the plurality of sub pixels R, G and B constituting each of the plurality of unit pixels UP formed in the display panel 100 is set to the sensing sub pixel 114, characteristic variation of the second driving transistor Tdr included in the sensing sub pixel 114 is sensed through the sensing mode, and characteristic variation of the first driving transistor DT included in the respective sub pixels R, G and B constituting each unit pixel UP is compensated on the basis of the sensed characteristic variation of the second driving transistor Tdr, whereby the aperture ratio may be improved and picture quality deterioration caused by characteristic variation of the driving transistors DT and Tdr included in the respective sub pixels R, G and B may be avoided.

Figure 10:
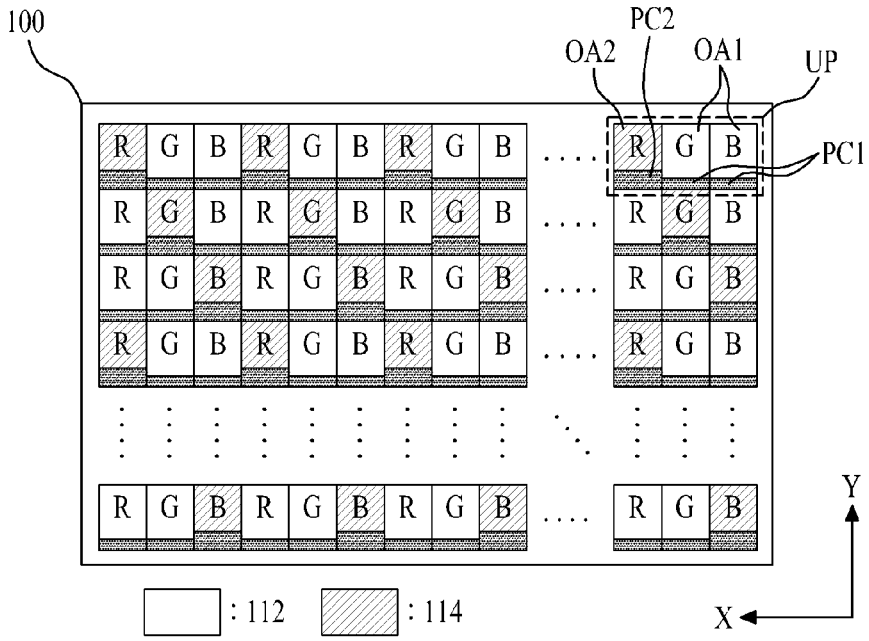
FIGS. 10 to 12 are diagrams illustrating various embodiments of a sensing sub pixel set in each unit pixel in an organic light emitting display device according to the embodiment of the present invention.
Figure 11:
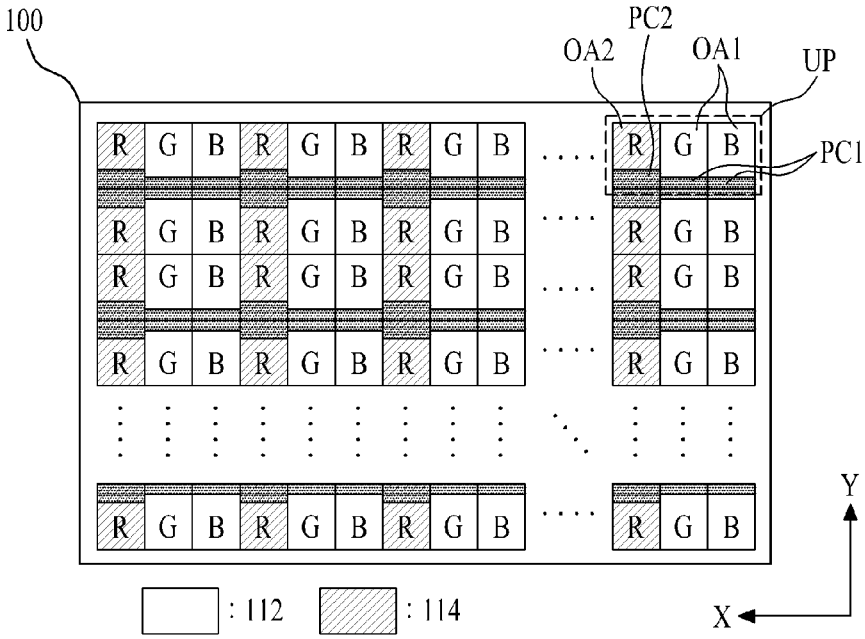
Figure 12:
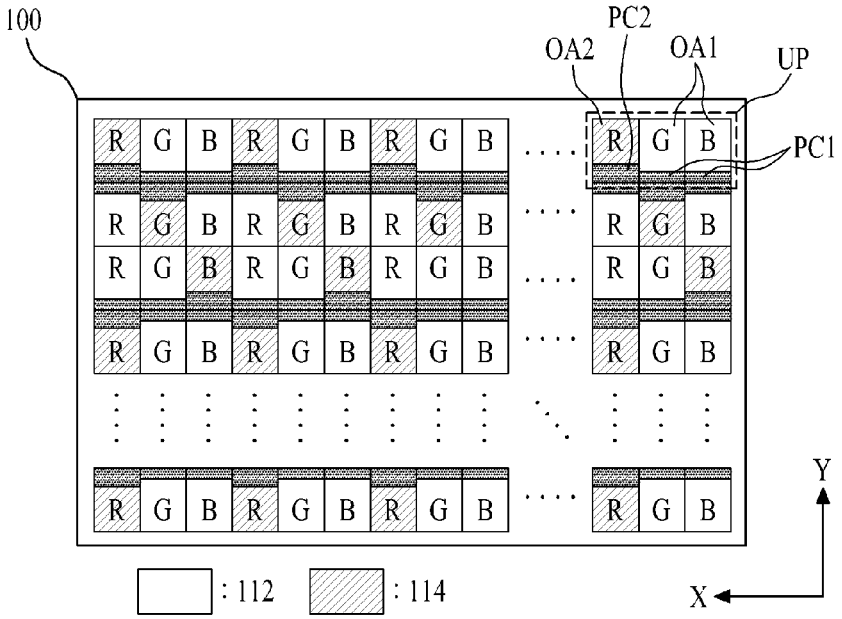

FIGS. 10 to 12 are diagrams illustrating various embodiments of a sensing sub pixel set in each unit pixel in an organic light emitting display device according to the embodiment of the present invention.

First of all, as will be aware of it from FIG. 10, the sensing sub pixels 114 according to the first modified embodiment are set to any one of the plurality of sub pixels R, G and B constituting each unit pixel UP. In this case, the sensing sub pixels 114 according to the first modified embodiment may be set to be shifted one by one in a unit of a horizontal line along a longitudinal direction X of the scan control line of the display panel 100. At this time, the sensing sub pixels 114 according to the first modified embodiment, which are set in each horizontal line, may be set to sub pixels of same color or sub pixels of different colors per adjacent unit pixels (UP). For example, the sensing sub pixels 114 according to the first modified embodiment may be set to red sub pixels R of each unit pixel UP in the 3m−2th horizontal line, green sub pixels G of each unit pixel UP in the 3m−1th horizontal line, and blue sub pixels B of each unit pixel UP in the 3mth horizontal line. As a result, the sensing sub pixels 114 according to the first modified embodiment are set to sub pixels of different colors per two unit pixels which are adjacent to each other in an up and down direction.

In the present invention that includes the aforementioned sensing sub pixels 114 according to the first modified embodiment, the sensing sub pixels 114 having an aperture ratio OA2 relatively smaller than an aperture ratio OA1 of the non-sensing sub pixels 112 are distributed in each unit pixel, whereby picture quality deterioration caused by luminance deviation between the non-sensing sub pixels 112 and the sensing sub pixels 114 may be minimized or avoided.

Next, as will be aware of it from FIG. 11, the sensing sub pixels 114 according to the second modified embodiment are set to sub pixels of same color per horizontal line, and may be formed such that pixel circuits PC2 of the sensing sub pixels 114 adjacent to each other in an up and down direction may share one sensing control line. In the present invention that includes the aforementioned sensing sub pixels 114 according to the second modified embodiment, the number of sensing control lines for driving the sensing sub pixels 114 may be reduced, whereby the aperture ratio may be more improved.

Next, as will be aware of it from FIG. 12, the sensing sub pixels 114 according to the third modified embodiment are set to sub pixels of same color per horizontal line. In this case, the sensing sub pixels 114 according to the third modified embodiment may be set to be shifted one by one in a unit of horizontal line, and may be formed such that pixel circuits PC2 of the sensing sub pixels 114 adjacent to each other in an up and down direction may share one sensing control line. In the present invention that includes the aforementioned sensing sub pixels 114 according to the third modified embodiment, the sensing sub pixels 114 may be distributed, whereby picture quality deterioration caused by luminance deviation between the non-sensing sub pixels 112 and the sensing sub pixels 114 may be minimized or avoided. Also, the number of sensing control lines for driving the sensing sub pixels 114 may be reduced, whereby the aperture ratio may be more improved.

As a result, in the organic light emitting display device according to the embodiment of the present invention, the aforementioned sensing sub pixels 114 are set to any one of the red, green and blue sub pixels R, G and B constituting unit pixel UP within the range that may avoid picture quality deterioration caused by luminance deviation between the non-sensing sub pixels 112 and the sensing sub pixels 114 and reduction of an aperture ratio based on the number of sensing control lines.

Meanwhile, although the present invention has been described that one unit pixel UP includes a red sub pixel R, a green sub pixel G and a blue sub pixel B, the unit pixel UP may include three or more sub pixels among a red sub pixel, a green sub pixel, a blue sub pixel, a white sub pixel, a light blue sub pixel and a dark blue sub pixel, and the sensing sub pixels 114 may be set to any one of three sub pixels.

Figure 13:
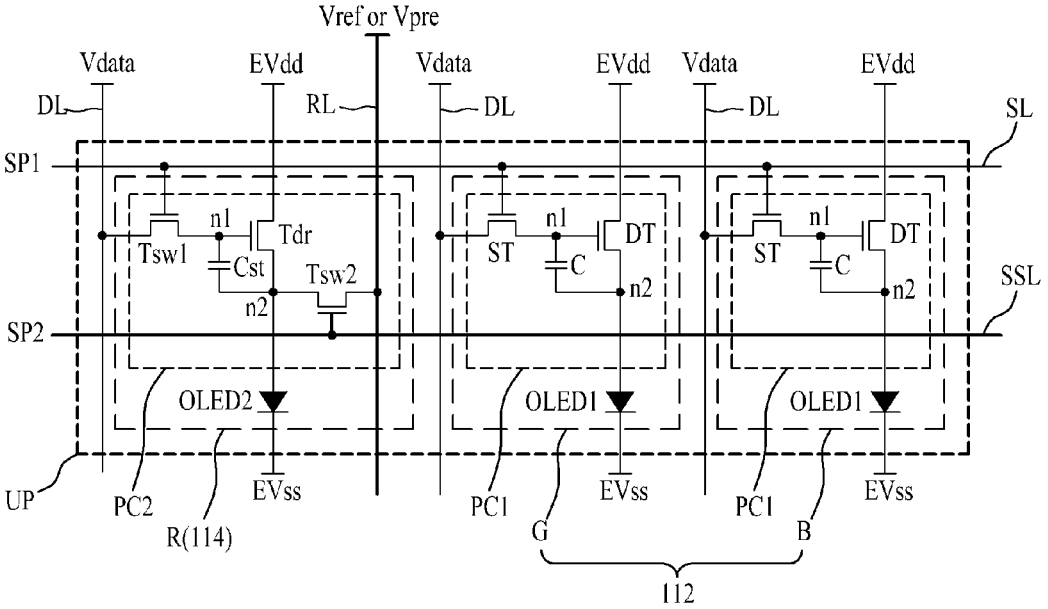
FIG. 13 is a diagram illustrating a modified pixel structure of a unit pixel shown in FIGS. 2 and 3.

On the other hand, although the present invention has been described that the respective transistors ST, DT, Tsw1, Tsw2 and Tdr included in the pixel circuits PC1 and PC2 of the respective sub pixels R, G and B are P type thin film transistors, the transistors ST, DT, Tsw1, Tsw2 and Tdr included in the pixel circuits PC1 and PC2 of the respective sub pixels R, G and B may be N type thin film transistor the transistors as shown in FIG. 13. In this case, in each of the pixel circuits PC1 and PC2, the source electrodes of the driving transistors DT and Tdr are connected to the anode electrodes of the organic light emitting diodes OLED1 and OLED2, the drain electrodes of the driving transistors DT and Tdr are connected to the first driving power line, and the second electrodes of the capacitors C and Cst and the drain electrodes of the second switching transistors DT and Tdr are commonly connected to the source electrodes of the driving transistors DT and Tdr and the anode electrodes of the organic light emitting diodes OLED1 and OLED2. Also, the voltage levels of the scan pulses SP1 and SP2 applied to the scan control line DL and the sensing control line SSL are changed such that the transistors ST, DT, Tsw1, Tsw2 and Tdr of the pixel circuits PC1 and PC2 correspond to N type thin film transistors.

Furthermore, in the organic light emitting display device according to the embodiment of the present invention, the structure of the sub pixels R, G and B formed in the display panel 100 and the method for driving the sensing sub pixels 114 according to the sensing mode or the display mode may be applied to all the organic light emitting display devices that include a pixel structure, which may sense characteristic variation of the driving transistor included in the sub pixel through the reference (or sensing) line, without limitation to FIGS. 4 and 8 and their description. For example, the structure of the sensing sub pixels 114 and the sensing method according to the present invention may be modified to a pixel structure and a sensing method, which are disclosed in the Korean Laid-Open Patent No. 10-2009-0046983, 10-2010-0047505, 10-2011-0057534, 10-2012-0045252, 10-2012-0076215, 10-2013-0066449, 10-2013-0066450 or 10-2013-0074147, or Korean Registered Patent No. 10-0846790 or 10-1073226.

According to the present invention, the following advantages may be obtained.

First of all, any one of the plurality of sub pixels constituting unit pixel is formed as the sensing sub pixel and the other sub pixels are formed as the non-sensing sub pixels, whereby the aperture ratio of the display panel may be improved.

In addition, characteristic variation of the driving transistor included in the sensing sub pixel is sensed and data which will be displayed in each sub pixel is corrected on the basis of the sensed characteristic variation, whereby the aperture ratio of the display panel may be improved and picture quality deterioration caused by characteristic variation of the driving transistor included in each sub pixel may be avoided.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device comprising:

a display panel that includes a plurality of sub pixels provided in a pixel region defined by a plurality of scan control lines and a plurality of data lines, each scan control line crossing each data line, and a panel driver for displaying an image in each sub pixel of the display panel, wherein some of the plurality of sub pixels have a first aperture ratio, and the other sub pixels have a second aperture ratio smaller than the first aperture ratio, wherein at least three sub pixels adjacent to one another constitute one unit pixel, and any one of the sub pixels constituting the unit pixel has the second aperture ratio and the other sub pixels have the first aperture ratio, wherein the display panel further includes a plurality of sensing control lines and a plurality of reference lines, wherein the sub pixels having the second aperture ratio are connected to the scan control line and the data line, wherein the sub pixels having the first aperture ratio are connected to the scan control line, the sensing control line, the reference line and the data line, wherein each sub pixel having the first aperture ratio includes:

a first organic light emitting device emitting light through a current;

a switching transistor outputting the data voltage supplied to the data line in accordance with the scan pulse supplied to the scan control line;

a first driving transistor controlling the current flowing in the first organic light emitting device in accordance with the data voltage output from the switching transistor; and a capacitor connected between source-gate electrodes of the first driving transistor, storing the data voltage, and wherein each sub pixel having the second aperture ratio includes:

a second organic light emitting device emitting light through a current;

a first switching transistor outputting the data voltage supplied to the data line in accordance with the scan pulse supplied to the scan control line;

a second driving transistor controlling the current flowing in the second organic light emitting device in accordance with the data voltage output from the first switching transistor;

a capacitor connected between source-gate electrodes of the second driving transistor, storing the data voltage; and a second switching transistor supplying a voltage supplied to the reference line to an anode electrode of the second organic light emitting device in accordance with the scan pulse of the sensing control line, and wherein the panel driver sets the sub pixels having the second aperture ratio to sensing sub pixels and sets the sub pixels having the first aperture ratio to non-sensing sub pixels, generates sensing data by sensing characteristic variation of the second driving transistor included in the sensing sub pixels through each of the plurality of reference lines, and displays input data of each sub pixel in the corresponding sub pixel by correcting the input data on the basis of the sensing data of the sensing sub pixels.

2. The organic light emitting display device of claim 1, wherein each of the plurality of sub pixels includes:

an organic light emitting device emitting light through a current; and a pixel circuit having at least two transistors and at least one capacitor, controlling the current flowing in the organic light emitting device on the basis of a scan pulse supplied to the scan control line and a data voltage supplied to the data line, and the pixel circuit of the sub pixels having the first aperture ratio includes transistors different from the number of transistors included in the pixel circuit of the sub pixels having the second aperture ratio.

3. The organic light emitting display device of claim 1, wherein the panel driver includes a timing controller correcting the input data of each sub pixel on the basis of the sensing data of the sensing sub pixels, and wherein the timing controller generates compensation data of the sensing sub pixels, which are intended to compensate for characteristic variation of the second driving transistor included in the sensing sub pixels on the basis of the sensing data of the sensing sub pixels, generates compensation data of the non-sensing sub pixels, which are intended to compensate for characteristic variation of the first driving transistor included in the non-sensing sub pixels of each unit pixel through interpolation based on the compensation data of the sensing sub pixel, and corrects input data of the corresponding sub pixels on the basis of the compensation data of each of the sensing sub pixels and the non-sensing sub pixels.

4. The organic light emitting display device of claim 1, wherein the second switching transistors of the sub pixels having the second aperture ratio, which are set in two unit pixels adjacent to each other in an up and down direction, share one sensing control line.

5. The organic light emitting display device of claim 4, further comprising a panel driver for displaying an image in each sub pixel of the display panel, and wherein the panel driver sets the sub pixels having the second aperture ratio to sensing sub pixels and sets the sub pixels having the first aperture ratio to non-sensing sub pixels, generates sensing data by sensing characteristic variation of the second driving transistor included in the sensing sub pixels through each of the plurality of reference lines, and displays input data of each sub pixel in the corresponding sub pixel by correcting the input data on the basis of the sensing data of the sensing sub pixels.

6. The organic light emitting display device of claim 5, wherein the panel driver includes a timing controller correcting the input data of each sub pixel on the basis of the sensing data of the sensing sub pixels, and wherein the timing controller generates compensation data of the sensing sub pixels, which are intended to compensate for characteristic variation of the second driving transistor included in the sensing sub pixels on the basis of the sensing data of the sensing sub pixels, generates compensation data of the non-sensing sub pixels, which are intended to compensate for characteristic variation of the first driving transistor included in the non-sensing sub pixels of each unit pixel through interpolation based on the compensation data of the sensing sub pixel, and corrects input data of the corresponding sub pixels on the basis of the compensation data of each of the sensing sub pixels and the non-sensing sub pixels.

7. The organic light emitting display device of claim 1, wherein the sub pixels having the second aperture ratio are set as sub pixels of different colors per unit pixels adjacent to each other in an up and down direction.

8. The organic light emitting display device of claim 7, further comprising a panel driver for displaying an image in each sub pixel of the display panel, and wherein the panel driver sets the sub pixels having the second aperture ratio to sensing sub pixels and sets the sub pixels having the first aperture ratio to non-sensing sub pixels, generates sensing data by sensing characteristic variation of the second driving transistor included in the sensing sub pixels through each of the plurality of reference lines, and displays input data of each sub pixel in the corresponding sub pixel by correcting the input data on the basis of the sensing data of the sensing sub pixels.

9. The organic light emitting display device of claim 8, wherein the panel driver includes a timing controller correcting the input data of each sub pixel on the basis of the sensing data of the sensing sub pixels, and wherein the timing controller generates compensation data of the sensing sub pixels, which are intended to compensate for characteristic variation of the second driving transistor included in the sensing sub pixels on the basis of the sensing data of the sensing sub pixels, generates compensation data of the non-sensing sub pixels, which are intended to compensate for characteristic variation of the first driving transistor included in the non-sensing sub pixels of each unit pixel through interpolation based on the compensation data of the sensing sub pixel, and corrects input data of the corresponding sub pixels on the basis of the compensation data of each of the sensing sub pixels and the non-sensing sub pixels.

* * * * *